United States Patent [19]

Monroe

[11] 4,453,796

[45] Jun. 12, 1984

[54] COAXIAL CONNECTOR PLUG

[75] Inventor: Kevin T. Monroe, Harrisburg, Pa.

[73] Assignee: AMP Incorporated, Harrisburg, Pa.

[21] Appl. No.: 534,846

[22] Filed: Sep. 22, 1983

Related U.S. Application Data

[62] Division of Ser. No. 390,427, Jun. 21, 1982, Pat. No. 4,412,717.

[51] Int. Cl.[3] ..... H01R 17/18

[52] U.S. Cl. ..... 339/177 R; 339/221 R

[58] Field of Search ..... 339/177 R, 177 E, 17 C, 339/220 R, 221 R

[56] References Cited

U.S. PATENT DOCUMENTS

| | | | |
|---|---|---|---|
| 3,437,960 | 4/1969 | Ziegler | 339/177 R |
| 3,879,103 | 4/1975 | Peltola et al. | 339/177 R |
| 3,910,665 | 11/1975 | Stull | 339/177 R |
| 4,119,359 | 10/1978 | Schultz | 339/177 R |

*Primary Examiner*—Joseph H. McGlynn
*Assistant Examiner*—Paula Austin
*Attorney, Agent, or Firm*—Adrian J. LaRue

[57] ABSTRACT

A coaxial jack connector adapted to electrically connect with a coaxial plug connector and to be electrically connected to conductive members of a substrate member comprises a metal tubular member in the form of an outer contact member and includes contact elements at an inner end which extend substantially parallel with respect to a longitudinal axis of the tubular member for electrical connection with respective conductive members of a substrate member. A dielectric member is disposed along the tubular member and has a bore extending therethrough. A projection on the tubular member and a recess in the dielectric member secure the dielectric member in position in the tubular member. A contact member has a first section disposed along the bore of the dielectric member and a second section extends outwardly from an inner end of the dielectric member and is substantially parallel with the contact elements but spaced therefrom for electrical connection with a conductive member of the substrate member and means are provided by the first section of the center contact member and the dielectric member securing the center contact member in the bore of the dielectric member.

9 Claims, 7 Drawing Figures

COAXIAL CONNECTOR PLUG

This is a division of application Ser. No. 390,427, filed June 21, 1982, U.S. Pat. No. 4,412,717.

FIELD OF THE INVENTION

This invention relates to electrical connectors and more particularly to coaxial connectors of the plug type.

BACKGROUND OF THE INVENTION

U.S. patent application Ser. No. 210,694 filed Nov. 26, 1980 discloses a coaxial connector of the SMB type. This connector was found to be difficult to assemble and to terminate for the reasons that the tolerances were difficult to maintain between a stamped and formed spring contact member and a drawn shell member so that when they were assembled together with a dielectric spacer in the spring contact member, these parts would in many cases not remain assembled and would therefore cause terminations not to be easily made when the center contact terminated to the center conductor of a coaxial cable was inserted within the dielectric spacer.

SUMMARY OF THE INVENTION

According to the present invention, a coaxial connector comprises a dielectric spacer captured in an inner shell. A forward part of the inner shell is secured within a tubular section of a spring contact member with leaf spring contact members having contact sections extending axially along and spaced from a forward part of the dielectric spacer and bent back sections extending along the contact sections. An outer shell has a rear section crimpably secured onto the tubular section of the spring contact member and a forward section extending along the leaf spring contact members with the forward end being rolled in to serve as an entrance to the connector. A center contact is crimpable onto a center conductor of a stripped end of a coaxial cable, the crimped center contact is inserted into the dielectric spacer, and an outer conductor of the coaxial cable is crimped onto the inner shell.

According to another embodiment of the present invention, a coaxial jack connector adapted to electrically connect with a coaxial plug connector and to be electrically connected to conductive members of a substrate member comprises a metal tubular member in the form of an outer contact member and includes contact elements at an inner end which extend substantially parallel with respect to a longitudinal axis of the tubular member for electrical connection with respective conductive members of a substrate member. A dielectric member is disposed along the tubular member and has a bore extending therethrough. A projection on the tubular member and a recess in the dielectric member secure the dielectric member in position in the tubular member. A contact member has a first section disposed along the bore of the dielectric member and a second section extends outwardly from an inner end of the dielectric member and is substantially parallel with the contact elements but spaced therefrom for electrical connection with a conductive member of the substrate member and means are provided by the first section of the center contact member and the dielectric member securing the center contact member in the bore of the dielectric member.

DETAILED DESCRIPTION OF PREFERRED EMBODIMENTS

Figure 1:
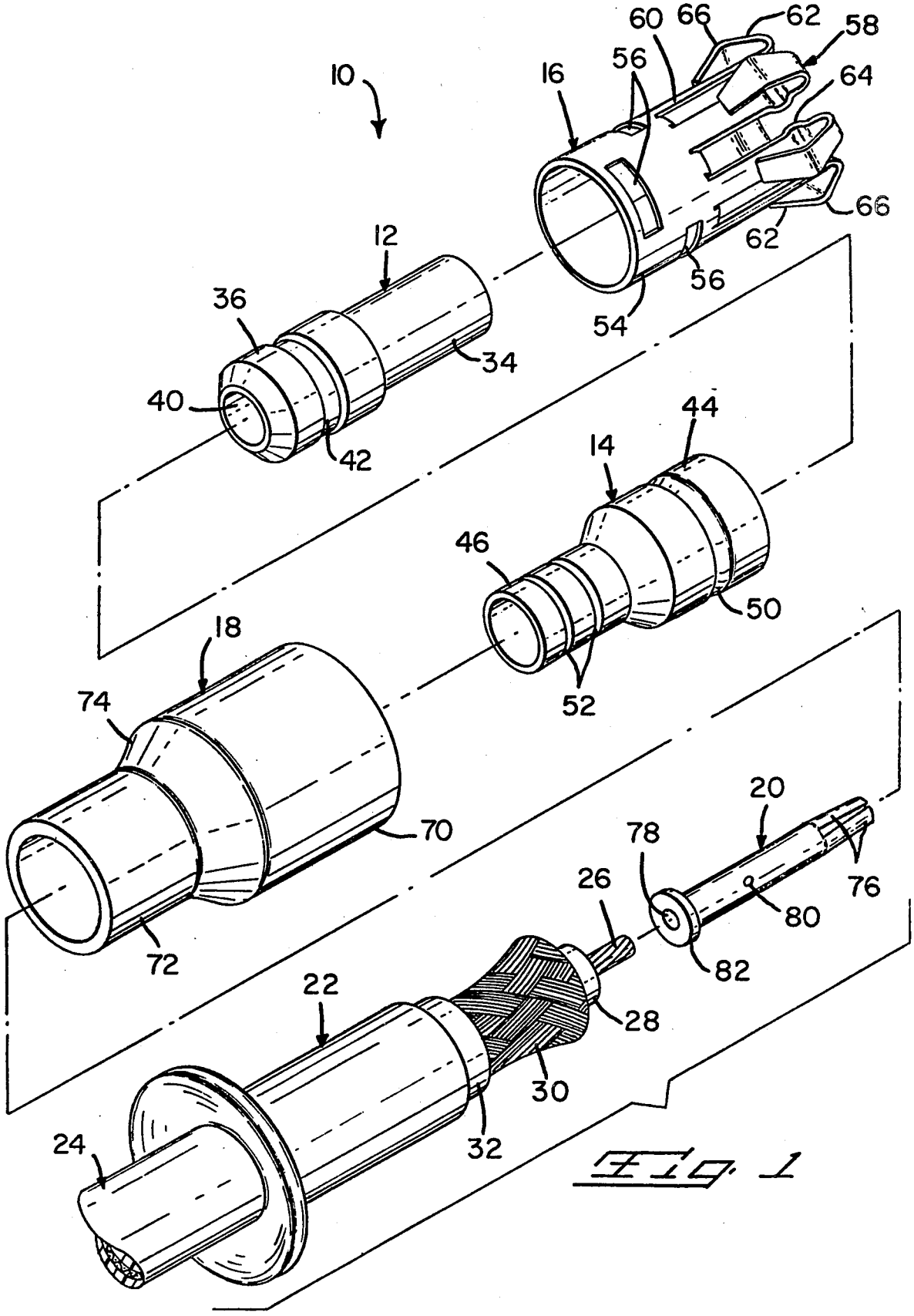
FIG. 1 is an exploded view of the parts of the coaxial connector plug of the present invention.

Referring to FIGS. 1 through 4, the invention comprises a coaxial connector 10 in the form of a plug including a dielectric spacer 12, an inner shell 14, a spring contact member 16, an outer shell 18, a center electrical contact 20, and a crimping ferrule 22. The plug is intended for termination onto a coaxial transmission cable 24 comprising a center conductor 26, surrounded by a dielectric layer 28, which in turn is surrounded by an outer conductive shield 30 and an outer insulative sheath 32.

Dielectric spacer 12 is molded from a suitable dielectric material and has a generally elongate configuration that unitarily includes a forward cylindrical section 34 and a rear cylindrical section 36. An axial bore 38 extends through spacer 12 and is in communication with annular recess 40 in section 36. Annular recess 42 is located in the exterior surface of section 36. The end surface of section 36 is beveled.

Inner shell 14 is of a unitary drawn construction and includes large diameter section 44 and small diameter section 46. A beveled transition section 48 connects sections 44 and 46 together. An inwardly-directed annular projection 50 is located in section 44 and annular grooves 52 are located in the exterior surface of section 46. Shell 14 is formed from brass or suitable metal and is bright nickel plated.

Spring contact member 16 is stamped and formed in accordance with common practice from beryllium copper or a metal having suitable spring characteristics. It is nickel plated and has a tubular section 54 in which rectangular openings 56 are located. A plurality of spring contacts 58 are annularly spaced about the forward end of section 54 and extend forwardly therefrom. Each spring contact 58 includes an inner leaf spring 60 and outer leaf spring 62 which is bent back and extends along leaf spring 60 in V-shape configuration. Leaf springs 60 have arcuate projections 64 adjacent outer ends thereof. Leaf springs 62 have increasing width from their jointure with leaf springs 60 to just after their bights 66. The outside surfaces of arcuate projections 64 and bights 66 are gold plated. Inwardly-directed lugs 68 are located between leaf springs 60.

Outer shell 18 is a drawn part from brass or like material and includes a large diameter section 70, small diameter section 72 interconnected together by beveled section 74.

Center electrical contact 20 is formed from beryllium copper or like metal as a tubular member which is gold plated and includes arcuate spring contact members 76, bore 78, sight hole 80, and annular flange 82.

Crimping ferrule 22 is formed from copper or like material as a tubular member which is tin plated and has a beveled flange 84 which terminates as a curved end.

In assembly, section 36 of dielectric spacer 12 is inserted into section 44 of inner shell 14 with the end beveled surface of section 36 engaging beveled section 48 and annular projection 50 engaging annular recess 42 thereby securing spacer 12 and shell 14 together. This assembly is inserted into tubular section 54 of spring contact member 16 until the front end of section 44 engages lugs 68.

Figure 4:
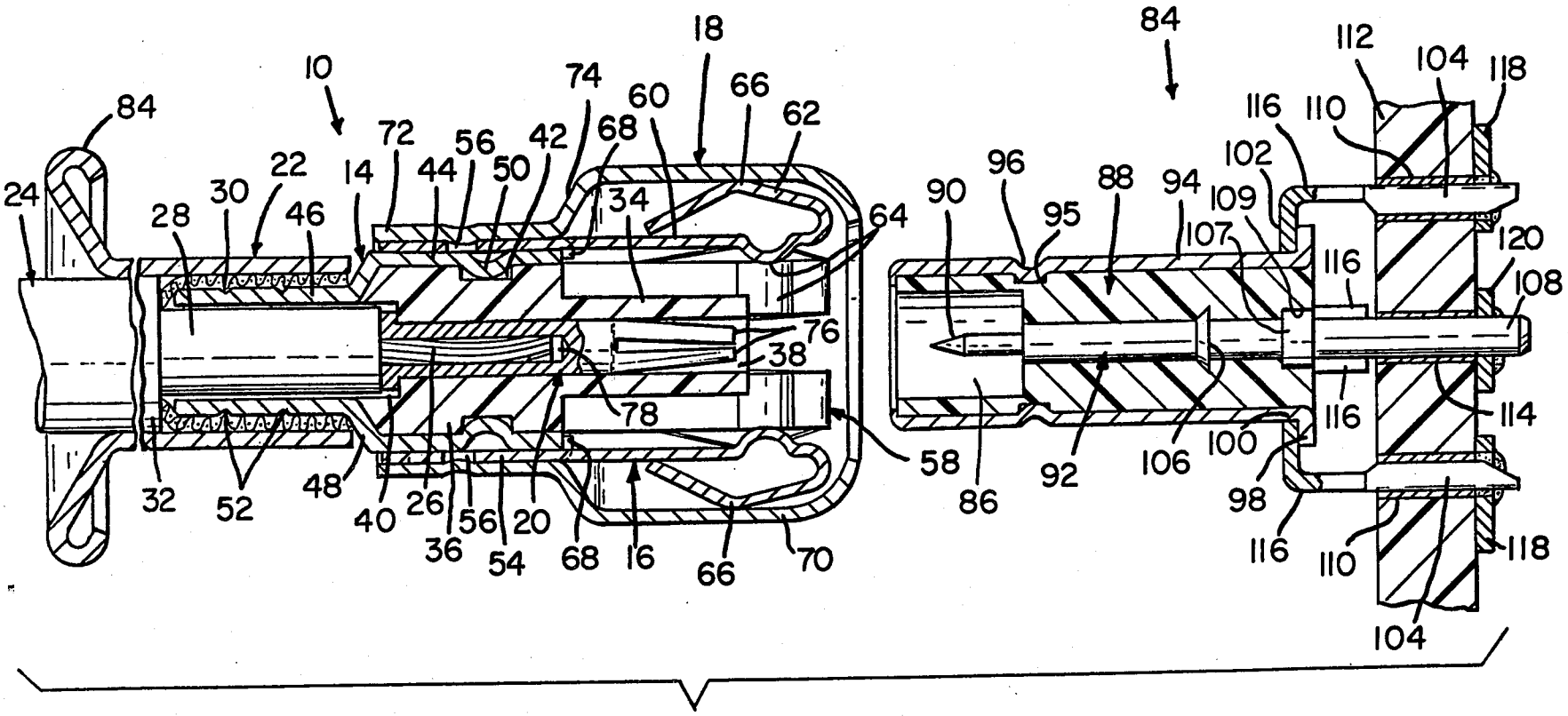
FIG. 4 is a cross-sectional view of the coaxial connector plug terminated onto the coaxial cable and the mating jack exploded therefrom.

Outer shell 18 is positioned onto spring contact member 16 with small diameter section 72 engaging tubular section 54 and large diameter section 70 extending along spring contacts 58. Crimping action is applied to section 72 in accordance with conventional crimping practices thereby crimping section 72 onto section 54 which also causes flow of metal of section 72 into openings 56. The front end of section 70 is rolled inwardly forming an entrance into plug coaxial connector 10 as shown in FIG. 4 and protecting the leaf spring contact members. These assembled parts of the coaxial connector are ready for termination onto a coaxial cable.

Figure 2:
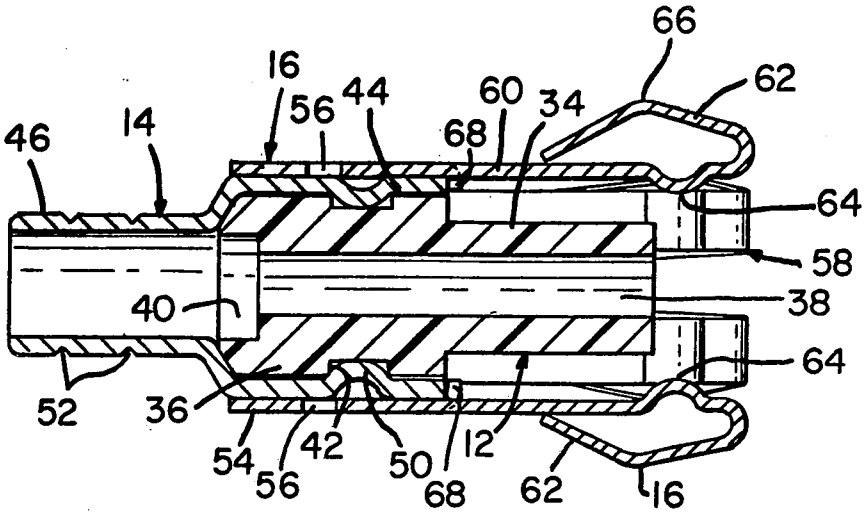
FIG. 2 is a cross-sectional view of a dielectric spacer affixed to the inner shell and these assembled parts inserted into the spring contact member.
Figure 3:
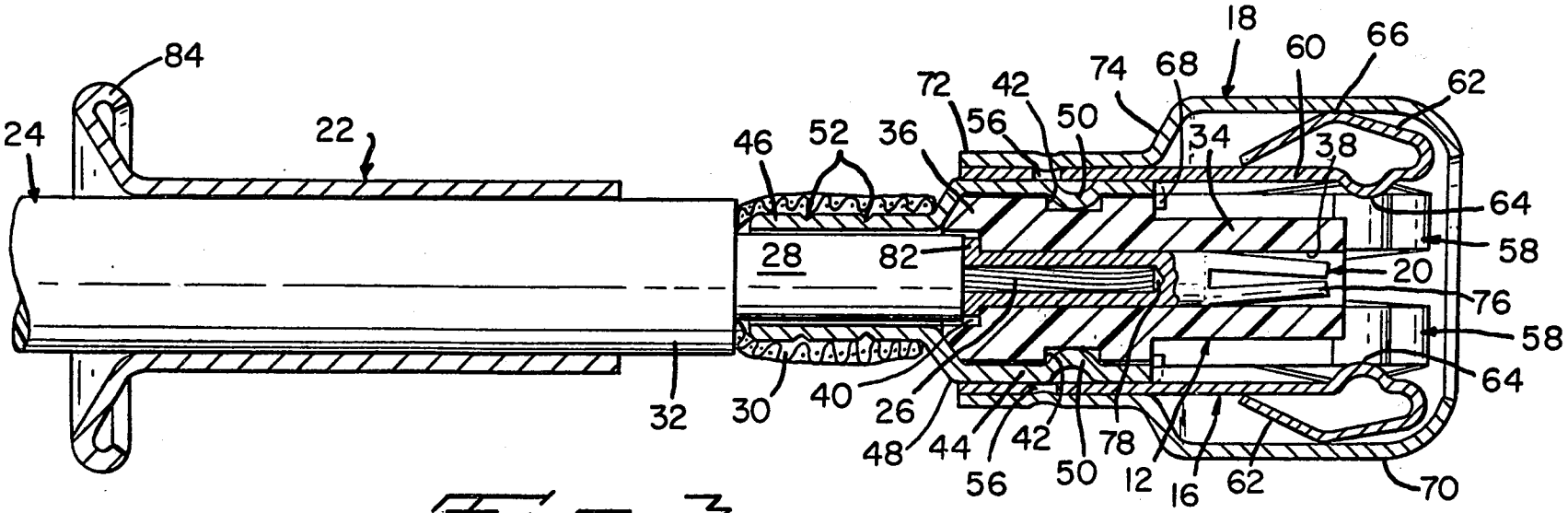
FIG. 3 is a cross-sectional view of the assembly of FIG. 2 crimpably secured in the outer shell and the center contact terminated on the center conductor of the coaxial cable.

To terminate coaxial connector 10 onto a stripped end of coaxial cable 24, crimping ferrule 22 is placed onto sheath 32, center conductor 26 is inserted into bore 78 of center contact 20 with flange 82 engaging dielectric layer 28 whereafter center contact 20 is crimped onto center conductor 26. Terminated center contact 20 is inserted into bore 38 of dielectric spacer 12 of the assembled connector with flange 82 being disposed in annular recess 40, dielectric layer 28 extends along the inner surface of section 46 of inner shell 14, and outer shield 30 is positioned onto the outer surface of section 46. Crimping ferrule 22 is positioned against beveled section 48 of inner shell 14 and a conventional crimping tool (not shown) crimps ferrule 22 onto shield 30 and sheath 32 thereby terminating coaxial connector 10 onto the inner and outer conductors of coaxial cable 24 as shown in FIG. 2.

Connector 10 is electrically connected to coaxial jack 84 as shown in FIG. 4 with section 34 of dielectric spacer 12 positioned within recessed area 86 of dielectric member 88 and spring contact members 76 of center contact 20 electrically connected with center contact pin 90 of center contact member 92 secured in dielectric member 88. Outer contact member 94 of jack 84 is disposed in the space between section 34 of spacer 12 and leaf springs 60 of spring contacts 58 with arcuate projections 64 engaging annular recess 96 of outer contact member 94. The beveled leading edge of member 94 and the arcuate configurations of projections 64 enable plug 10 to be easily connected with jack 84. The spring forces of leaf springs 60 coupled with the spring forces of leaf springs 62 being enhanced by bights 66 engaging section 70 of outer shell 18 provide ease of mating engagement between plug and jack as well as optimum retention and excellent electrical connection.

Figures 5, 6, 7:
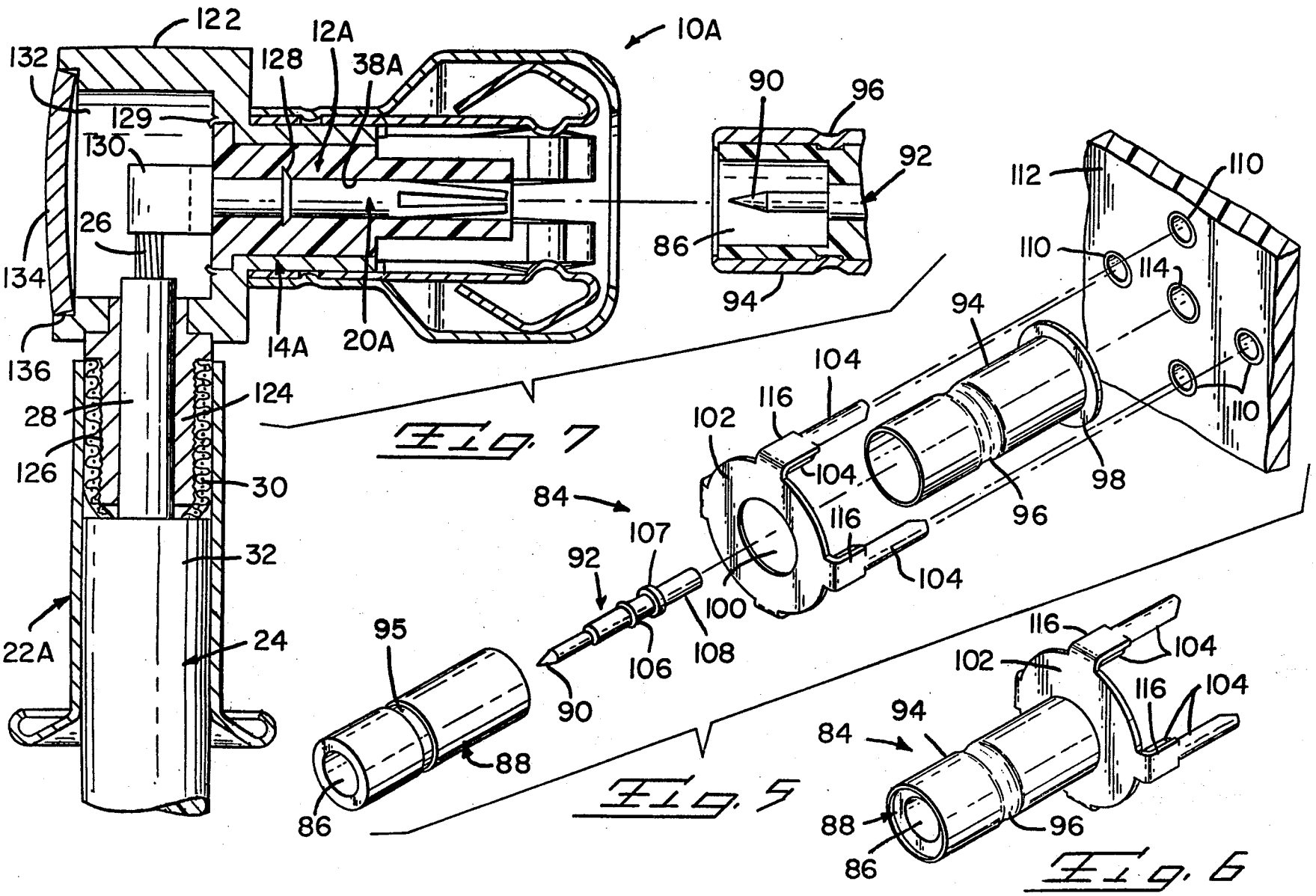
FIG. 5 is an exploded perspective view of the parts of the coaxial jack.
FIG. 6 is a perspective view of FIG. 5 in an assembled condition.
FIG. 7 is a cross-sectional view of a right angle coaxial connector plug and coaxial jack exploded therefrom.

Jack 84 can take the form illustrated in FIGS. 4 through 6. Outer conductor 94 is a drawn tubular member with a flange 98 and annular projection 96. Outer conductor 94 is inserted through opening 100 of a stamped and formed contact member 102 containing U-shaped contacts 104 having pointed ends. Flange 98 is soldered to contact member 102 and center contact member 92 is secured in bore 87 of dielectric member 88 via barb 106 and annular projection 107 in annular recess 109 so that center contact pin 90 is positioned within recessed area 86 of member 88 and center pin member 108 is positioned centrally of contacts 104 when dielectric member 88 is secured in outer conductor 94. Dielectric 88 is secured in outer conductor 94 via annular recess 95 engaging annular projection 96.

Contacts 104 are easily inserted into holes 110 in a printed circuit board 112 with the aid of pointed ends of the contacts while center pin member 108 is inserted in hole 114. Flat sections 116 serve to position jack 84 relative to board 112. Contacts 104 and member 108 are soldered respectively to ground plane 118 and signal conductor 120 with the U-shaped configurations of contacts 104 enabling the solder to wick up into engagement with the ground plane.

FIG. 7 illustrates an alternative embodiment of the plug coaxial connector 10A which is substantially identical to that of plug coaxial connector 10 except that connector 10A is a right angle coaxial connector and inner shell 14A has an annular section 122 from which depends integral ferrule 124 having knurls 126 in its external surface. Dielectric spacer 12A has center electrical contact 20A secured in bore 38A by barb 128 and clinched section 129. Ferrule section 130 of contact 20A is located in bore 132 of section 122 and receives center conductor 26 of coaxial cable 24 therein when dielectric layer 28 is positioned in ferrule 124 and conductive shield 30 is positioned onto the external surface of ferrule 124. Crimping ferrule 22A is crimped onto ferrule 124, shield 30, and sheath 32, and ferrule section 130 is crimped onto center conductor 26 in accordance with the disclosure of U.S. patent application Ser. No. 364,101 filed Mar. 31, 1982, which is incorporated herein by reference. If desired, center conductor 26 can be soldered to ferrule section 130. After coaxial cable 24 has been terminated to connector 10A, metal closure member 134 is force fit into recess 136 to seal the cavity containing the center conductor termination.

I claim:

1. A coaxial connector of the jack type adapted to electrically connect with a coaxial plug connector, comprising:

a metal tubular member having a flange at one end;

a dielectric member disposed along said tubular member and having a bore extending therethrough;

means provided by said tubular member and said dielectric member securing said dielectric member within said tubular member;

a center contact member having a first section disposed along said bore and a second section extending outwardly from an inner end of said dielectric member;

means provided by said first section of said center contact member securing said center contact member in said bore, said tubular member with said dielectric member secured therein and said center contact member secured in said bore defining a coaxial contact assembly;

an outer contact member has an opening through which said coaxial contact assembly extends with said flange engaging and being electrically connected to said outer contact member; and contacts extending outwardly from said outer contact member and extending substantially parallel with said second section of said center contact member but spaced therefrom.

2. a coaxial connector as set forth in claim 1, wherein said securing means securing said dielectric member within said tubular member comprises a projection in said tubular member disposed in a recess in said dielectric member.

3. A coaxial connector as set forth in claim 1, wherein said securing means securing said first section of said center contact member in said bore of said dielectric member comprises a barb that bites into the material of the dielectric member.

4. a coaxial jack connector adapted to electrically connect with a coaxial plug connector and to be electrically connected to conductive members of a substrate member, comprising:

a metal tubular member defining an outer contact member and including contact elements at an inner end which extend substantially parallel with respect to a longitudinal axis of said tubular member for electrical connection with respective conductive members of the substrate member;

a dielectric member disposed along said tubular member and having a bore extending therethrough;

means provided by said tubular member and said dielectric member securing said dielectric member in position in said tubular member;

a center contact member having a first section disposed along said bore and a second section extending outwardly from an inner end of said dielectric member and being substantially parallel with said contact elements but spaced therefrom for electrical connection with a conductive member of the substrate member; and means provided by said first section of said center contact member and said dielectric member securing said center contact member in said bore.

5. A coaxial jack connector as set forth in claim 4, wherein said dielectric member has a recess at its upper end in which a contact pin section of said center member is disposed.

6. A coaxial jack connector as set forth in claim 4, wherein said contact elements are U-shaped.

7. A coaxial jack connector as set forth in claim 4, wherein said contact elements have flat sections which serve to position the coaxial jack connector relative to the substrate member.

8. A coaxial jack connector as set forth in claim 4, wherein said securing means securing said dielectric member in said tubular member comprises a projection in said tubular member disposed in a recess in said dielectric member.

9. A coaxial jack connector as set forth in claim 4, wherein said securing means securing said first section of said center contact member in said bore of said dielectric member comprises a barb that bites into the material of the dielectric member.

* * * * *

UNITED STATES PATENT OFFICE

CERTIFICATE OF CORRECTION

Patent No. 4,453,796 Dated June 12, 1984

Inventor(s) Kevin T. Monroe

It is certified that error appears in the above-identified patent and that said Letters Patent are hereby corrected as shown below:

Column 6, line 13, after "center" add ---contact---.

Signed and Sealed this

Twenty-fifth Day of September 1984

[SEAL]

Attest:

GERALD J. MOSSINGHOFF

Attesting Officer

Commissioner of Patents and Trademarks